US008151511B2

(12) United States Patent
Gentilini

(10) Patent No.: US 8,151,511 B2
(45) Date of Patent: Apr. 10, 2012

(54) GUN SIGHT MOUNT FOR PISTOLS

(75) Inventor: Claudio Gentilini, Brescia (IT)

(73) Assignee: Beretta USA Corp., Accokeek, MD (US)

( * ) Notice: Subject to any disclaimer, the term of this patent is extended or adjusted under 35 U.S.C. 154(b) by 204 days.

(21) Appl. No.: 12/756,345

(22) Filed: Apr. 8, 2010

(65) Prior Publication Data

US 2011/0247258 A1 Oct. 13, 2011

(51) Int. Cl.
*F41G 1/00* (2006.01)
*F41G 1/02* (2006.01)
*F41G 1/16* (2006.01)

(52) U.S. Cl. ..... 42/135; 42/111

(58) Field of Classification Search ..... 42/111, 42/124, 127, 128, 135–139
See application file for complete search history.

(56) References Cited

U.S. PATENT DOCUMENTS

| | | | | | |
|---|---|---|---|---|---|
| 2,610,406 | A * | 9/1952 | Chambers | 42/133 |
| 2,963,789 | A * | 12/1960 | Wilhelm | 42/137 |
| 4,200,989 | A * | 5/1980 | Brouthers | 42/137 |
| 4,388,772 | A * | 6/1983 | Maes | 42/135 |
| 4,628,611 | A * | 12/1986 | Ruffino | 42/137 |
| RE35,347 | E * | 10/1996 | Bindon | 42/145 |
| 5,878,521 | A * | 3/1999 | Warnock | 42/145 |
| 6,216,351 | B1 * | 4/2001 | Flubacher et al. | 42/145 |
| D443,016 | S * | 5/2001 | Nigh | D22/109 |
| D492,747 | S * | 7/2004 | LoRocco | D22/109 |
| 7,287,351 | B1 * | 10/2007 | Warren | 42/111 |
| 7,296,376 | B2 * | 11/2007 | Kidd | 42/136 |
| 7,451,566 | B1 * | 11/2008 | Price | 42/133 |
| 7,526,890 | B1 * | 5/2009 | Keng et al. | 42/136 |
| 7,562,486 | B2 * | 7/2009 | LoRocco | 42/132 |
| 7,610,712 | B2 * | 11/2009 | Ertl | 42/137 |
| 7,921,591 | B1 * | 4/2011 | Adcock | 42/113 |
| 2004/0010956 | A1 * | 1/2004 | Bubits | 42/144 |
| 2007/0234625 | A1 * | 10/2007 | Kidd | 42/111 |
| 2007/0240354 | A1 * | 10/2007 | Warren | 42/111 |

FOREIGN PATENT DOCUMENTS

DE 10358666 A1 * 8/2004

* cited by examiner

*Primary Examiner* — Michael Carone
*Assistant Examiner* — Joshua Freeman
(74) *Attorney, Agent, or Firm* — Ladas & Parry LLP

(57) ABSTRACT

An improved dove tail sight attachment system utilizing a displaceable spherical element to engage a mating hemispherical socket formed along the edge of a dove tail seat on a pistol slide.

5 Claims, 4 Drawing Sheets

GUN SIGHT MOUNT FOR PISTOLS

FIELD OF THE INVENTION

The present invention relates to improved mounting mechanisms for gun sights for small arms which provides for simple and easy replacement.

BACKGROUND OF THE INVENTION

Conventional gun sight attachments in the form of "dove tail" joints are generally employed in semiautomatic pistols and other small arms. Dove tail joints are usually machined in the pistol slide transverse to the gun axis, providing clamping of the sight in vertical direction with the sight prevented from lateral and transverse movement by the contact of the dove tail walls. This arrangement, while providing a solid coupling between the pistol slide and the annexed sight, is expensive because of the required close tolerances. Furthermore, such dove tails require special tools to assemble and disassemble the sights. Should the machined tolerances be inadequate, the shocks and vibrations of shooting inevitably will lead to the loosening and possible failure of attachment.

It is the object of the present invention to provide a gun sight attachment mechanism which makes the sight simple to assemble with and to disassemble from the pistol, with no special tools or skills required. The new mechanism is very simple, inexpensive, and permits alternative materials such as plastics to be employed for the gun sights. The new mechanism uses detent balls which lockingly register with sockets formed in the slide when engaged by a sliding lock pin. Detachment is achieved by removal of the lock pin.

For a more complete understanding of the present invention and its attendant advantages, reference should be made to the drawings in conjunction with the detailed description of the invention.

DETAILED DESCRIPTION OF THE INVENTION

Figure 1:
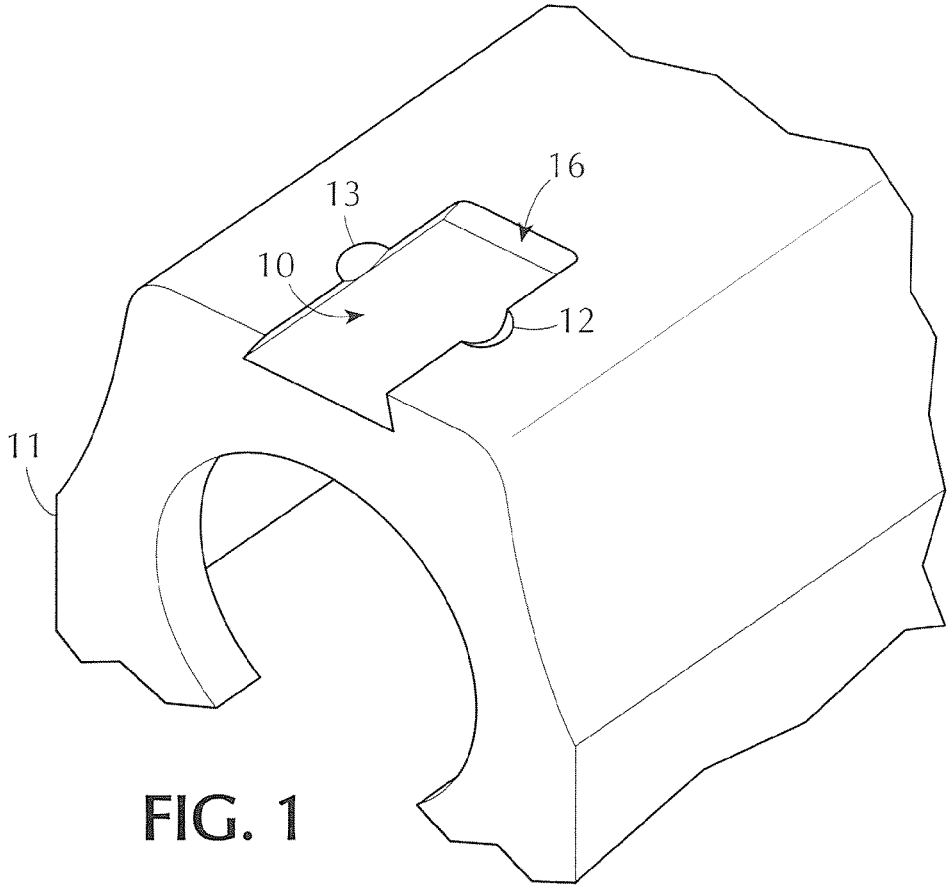
FIG. 1 is a partial perspective view of the front portion of a pistol slide having a front sight dovetail slot formed therein.
Figure 2:
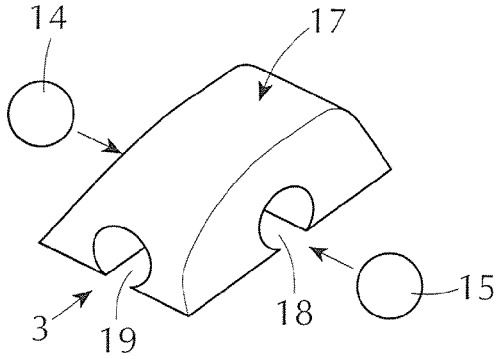
FIG. 2 is a perspective view of a front sight bar having hollow passages formed therein to receive a locking pin and spherical detents for mounting the front sight to the slide.

The gun sight mount of the invention includes a dove tail seat 10 formed on the front end of a pistol slide 11 provided with two lateral sockets 12, 13 machined in the shape of half cylinders to engage and retain the two steel detent balls 14, 15, and a back rest surface 16. A front bar sight 17 includes a transverse, cylindrical ball retention aperture 18, a longitudinal, axial, cylindrical channel 19 for reception of a locking pin 20 (solid pin or spring pin) and a rear access aperture 21 for insertion of a punch or a like simple tool for engaging and expelling the locking pin 20. The steel detent balls 14, 15 when engaged in their respective sockets 12, 13 secure the front sight bar to the slide by a detent action.

Figure 3:
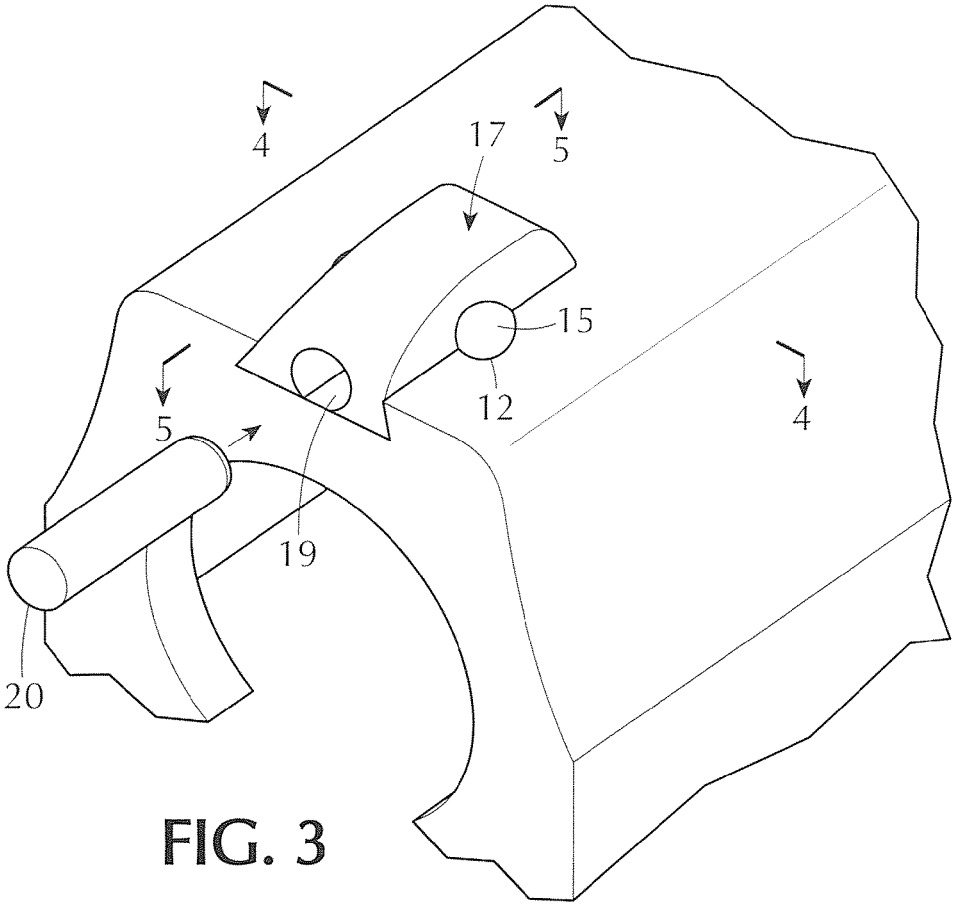
FIG. 3 is a perspective view of the front sight in the slide prior to insertion of the locking pin.
Figure 4:
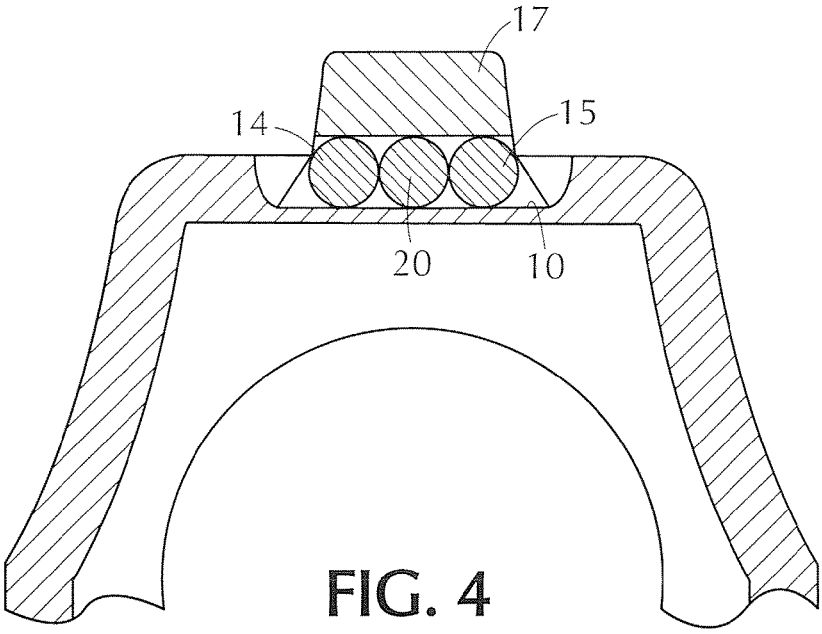
FIG. 4 is a cross-sectional view taken along line 4-4 of FIG. 3.
Figure 5:
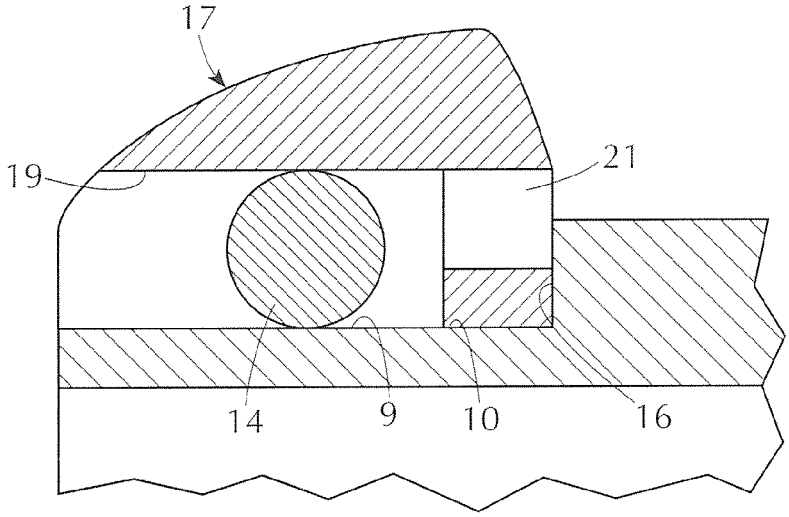
FIG. 5 is a cross-sectional view taken along line 5-5 of FIG. 3.

In accordance with the principles of the invention, the special dove tail seat 10, though somewhat similar in shape to a conventional dove tail groove, does not require tight machining tolerances. The retaining of the gun sight 17 in place is not provided by the friction generated by the dimensional interference between conventional dove tail groove and sight, but rather by the ball detents 14,15 engaging both in the sight 17 and in the dove tail seat. The sight 17, with the two detent balls inside in the ball retention aperture 18, is slidingly inserted in the dove tail seat 10 until it stops against the back rest surface 16. At this point, the sight 17, with the sockets 12, 13 perfectly aligned with the ball retention aperture 18, is ready to be secured in place by the insertion of the locking pin 20 in the longitudinal channel 19 and the consequent camming engagement with balls 14, 15 to cause a lateral shift of the balls 14, 15 into the sockets 12, 13 (FIG. 3). Importantly, the sight 17 is kept firmly secured, with no play or looseness, by the locking pin 20 engaging the steel balls 14, 15, as well as the bottom surface 9 of the dove tail seat 10 and the sight 17. Alternatively, if a spring pin rather than a solid pin is employed as the locking pin 20, the elastic compression of the spring will contribute to the locking of the sight to the slide. Escape of the locking pin, under the impact of the slide against the frame, is prevented by the rear access aperture 21 being of smaller diameter than that of longitudinal channel 19. Disassembly is obtained by expelling the locking pin 20 from the channel 19 by a punch or similar tool inserted in the access aperture 21 permitting the detent balls 14, 15 to retract from the sockets 12, 13 into the channel 19 so that the unlocked sight bar 17 may be slid forwardly out of the dove tail slot 10.

The advantages of the new front sight mounting mechanism include easy assembly and replacement of the sight without special skills or special tools, a hammer and punch being the only tools needed. Given the innovative mechanical retaining system, free of previously required tight tolerances and previously required related hard compression and stress of the two coupled parts (sight and dove tail), alternative comparative inexpensive materials for the sights, such as plastics, may be employed. Moreover, an assortment of sights, providing any desired different settings of the line of sight in windage and elevation, may be provided at low cost.

Figure 6:
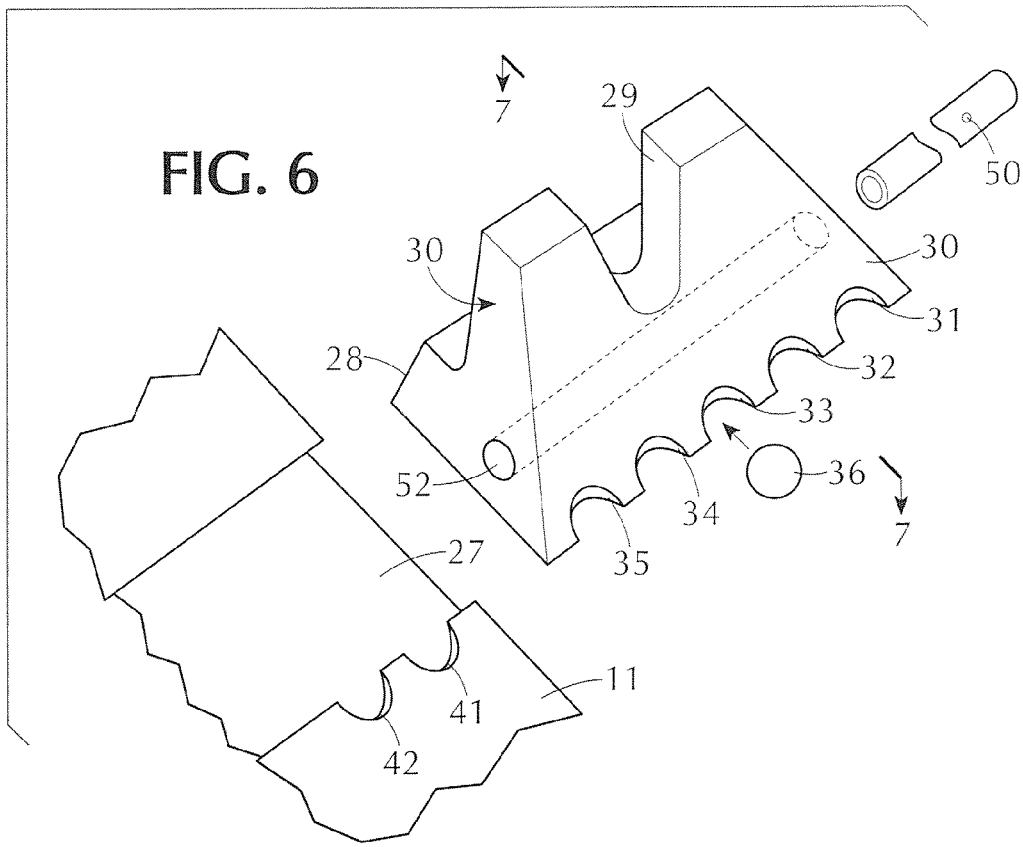
FIG. 6 is a perspective view of a rear sight having the detent lock of the invention adapted for mounting a rear sight on a multi-notched rear portion of a pistol slide.
Figure 7:
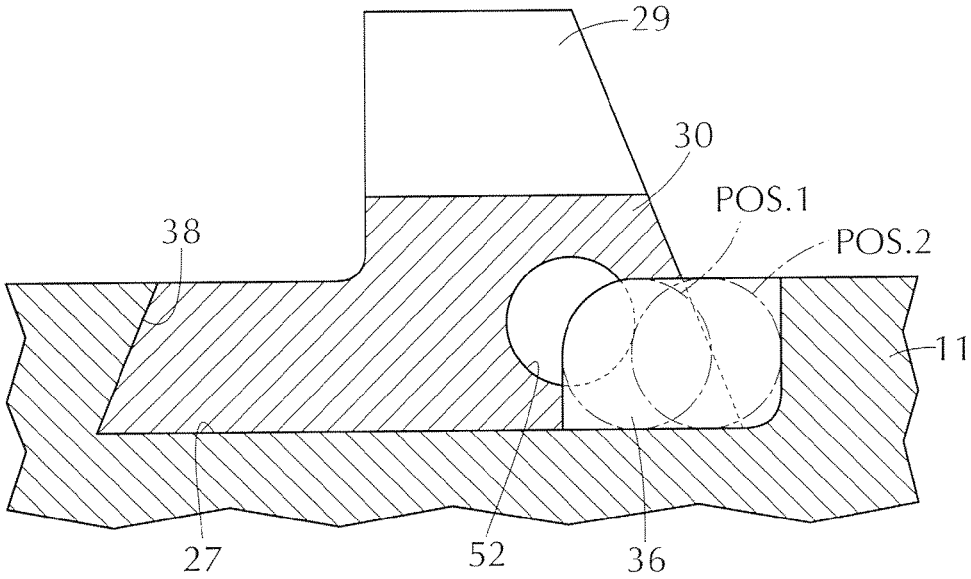
FIG. 7 is a cross-sectional view taken along line 7-7 of FIG. 6.
Figure 8:
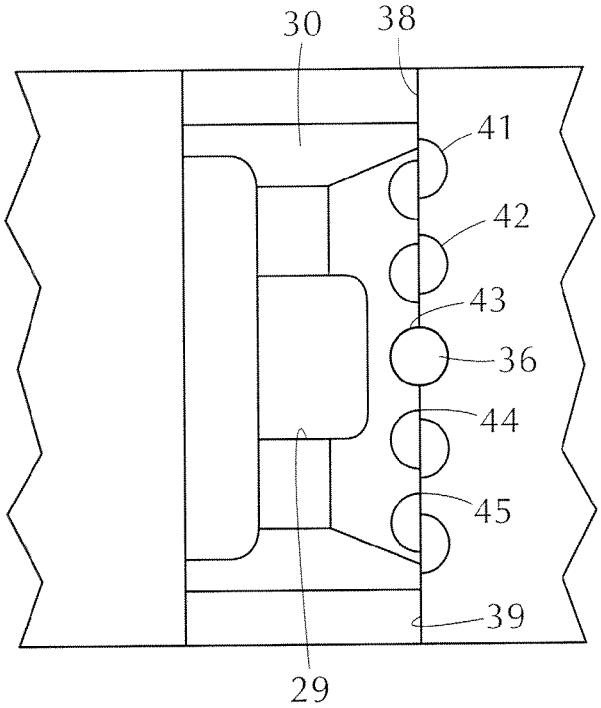
FIG. 8 is a top plan view of the rear sight of FIG. 6.

The principles of the invention may be adapted to usage in mounting a rear sight 30 having U-shaped sighting notch 29 and dovetail base 28 adapted to mate with transverse notch 27. With reference to FIGS. 6-8, a traditional transverse dove tail rear sight 30 is modified by machining a series of half-notches or sockets 31-35 each capable to receive a steel detent ball 36 inside the profile of the sight (FIG. 6, position 1). An equal number of half-notches or sockets 41-45 in the shape of hemispherical cavities are machined in the sight seat 38, along the back edge 39 of the dove tail. The sockets 41-45 are differently spaced than the notches 31-35 in the sight. They are machined with a different pitch as shown in the top view of FIG. 8. Specifically, central notch 33 of the sight is placed on the central axis of the sight while the central notch 43 of the seat is placed on the mid plane of the gun. The coincident location of notches 33, 43 is shown in FIG. 8, and represents a perfectly centered position of the sight with respect to the gun axis.

The different location of the notch 42 on the sight seat with respect to the corresponding notch 32 on the sight shifts the rear sight slightly to the right, when the two notches 32, 42 are assembled in registry. Similarly, notch 41, provides an increased shift to the right. Notch positions 44 and 45 are symmetrical with those of notches 42, 41 and provide for corresponding shifts to the left. In the illustrated mounting, there are five different selectable windage settings: two on the right, two on the left, plus the central "zero" position; however, it will be understood that variations may be obtained through different cylindrical arrangements of ball/notch diameter and position as may be desired. The rear sight can be kept firmly in place by insertion of a locking (or spring) pin 50 into transverse channel 52, to cam the steel ball 36 out from position 1 to position 2 (FIG. 7). The "multi notch" rear sight brings in the whole advantage of the steel ball detent system such as easy assembly/replacement (plus adjustability) and inexpensive construction due to the tight tolerance relief.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. A gun sight system comprising:

(a) a pistol slide having a gun sight seat in the shape of a generally longitudinally positioned dove tail having a bottom wall, parallel sloped side walls, and a vertical rear wall;

(b) opposed hemispherical notches formed in said side walls adjacent the upper surface of the slide;

(c) a gun sight having a longitudinal passage adapted to accommodate a pin, and having a transverse passage intersecting said longitudinal passage and disposed in said longitudinal passage adapted to house two detent balls for transverse displacement;

(d) two detent balls;

(e) a locking pin selectively engageable with said balls; and (f) an access port of smaller diameter than that of the longitudinal passage coaxially communicating with said longitudinal passage, whereby said pin may be contacted and displaced by an implement extending through said access port.

2. The gun sight system of claim 1, in which (a) said gun sight seat rear wall is substantially vertical.

3. The gun sight system of claim 1, in which (a) said gun sight has a dove tail shaped bottom portion adapted to be seated in said seat in said slide;

(b) said gun sight seat extends longitudinally in said slide, opening at the front edge of said slide.

4. A gun sight mounting apparatus having:

(a) a pistol slide;

(b) a transverse dovetail gun sight seat formed at upper surface thereof and having sloped side walls and a series of first hemispherical cavities formed in one of said sloped walls of said seat with a first predetermined spacing between said cavities;

(c) a gun sight with a dovetail base portion;

(d) a series of second hemispherical cavities formed in the base portion with second predetermined spacing and being selectively registrable with said first cavities in a series of different positions on said slide;

(e) a cylindrical passage extending through said gun sight and in communication with said first cavities;

(f) a detent ball;

(g) a locking pin disposed in said cylindrical passage and adapted to engage said ball and cam it into locking position in a pair of registered first and second cavities, whereby each pair of registered first and second cavities provides a unique, locked positioning of said gun sight on said slide with said ball engaged by said pin; and (h) whereby displacement of said pin out of said passage unlocks the gun sight from the slide.

5. The apparatus of claim 4, in which (a) the spacing of said first and second hemispherical cavities provides for a range of variations to compensate for windage adjustments in the sight.

* * * * *